US006315077B1

(12) United States Patent
Peacock et al.

(10) Patent No.: US 6,315,077 B1
(45) Date of Patent: Nov. 13, 2001

(54) INSERT FORMING HOLE TO RECEIVE MANHOLE STEP

(75) Inventors: Bobbie D. Peacock; Charles W. McInvale, both of Peachtree City, GA (US)

(73) Assignee: M. A. Industries, Inc., Peachtree City, GA (US)

( * ) Notice: Subject to any disclaimer, the term of this patent is extended or adjusted under 35 U.S.C. 154(b) by 0 days.

(21) Appl. No.: 09/136,825

(22) Filed: Aug. 20, 1998

(51) Int. Cl.[7] ..... E04G 3/00

(52) U.S. Cl. ..... 182/92; 182/90; 52/20; 52/184

(58) Field of Search ..... 182/90, 91, 92, 182/93, 82, 87; 52/20, 21, 184

(56) References Cited

U.S. PATENT DOCUMENTS

| | | | | |
|---|---|---|---|---|
| 890,573 | * | 6/1908 | Phelan | 52/20 X |
| 1,555,878 | | 10/1925 | Rust . | |
| 1,573,151 | | 2/1926 | Fishel . | |
| 1,627,554 | | 5/1927 | Fishel . | |
| 3,142,882 | | 8/1964 | Lovers . | |
| 3,299,984 | * | 1/1967 | Svedahl | 52/184 X |
| 3,374,859 | * | 3/1968 | Dobert | 52/184 X |
| 3,436,051 | | 4/1969 | Nakahara . | |
| 3,503,584 | | 3/1970 | Erhart et al. . | |
| 3,685,782 | | 8/1972 | Kowell . | |
| 3,685,783 | | 8/1972 | Hilson . | |
| 3,982,363 | | 9/1976 | Dorris . | |
| 4,100,997 | | 7/1978 | Peacock . | |
| 4,241,543 | * | 12/1980 | Foscarini et al. | 52/20 X |
| 4,610,330 | * | 9/1986 | Borst | 182/90 |
| 4,655,318 | * | 4/1987 | Bowen | 182/90 |
| 4,751,799 | * | 6/1988 | Ditcher et al. | 52/21 |
| 4,869,342 | * | 9/1989 | Borst | 182/90 |
| 5,081,802 | * | 1/1992 | Westhoff et al. | 52/20 |
| 5,174,910 | | 12/1992 | Pita . | |
| 5,437,431 | | 8/1995 | Pita . | |
| 5,611,225 | * | 3/1997 | Resch et al. | 70/422 |
| 5,882,142 | * | 3/1999 | Siglin et al. | 405/52 |
| 5,896,912 | * | 4/1999 | Monroe et al. | 164/134 |

* cited by examiner

*Primary Examiner*—Bruce A. Lev
(74) *Attorney, Agent, or Firm*—John S. Pratt, Esq.; Michael K. Dixon, Esq.; Kilpatrick Stockton LLP

(57) ABSTRACT

A frangible insert that is inserted in a pre-positioned bushing in the wall of a manhole form from the convex, easily reached side of the inner form wall. A key in the insert is received in a keyway in the bushing in the form wall so that the insert is properly oriented in the form. Concrete is then poured into the form, enveloping and affixing the insert within the man hole wall. A weakened, frangible region is provided on the insert in a position immediately adjacent to the form wall so that after the concrete is cured, the manhole and form can simply be separated, causing the portion of the insert embedded in the concrete to separate from the insert portion in the form bushing.

26 Claims, 5 Drawing Sheets

INSERT FORMING HOLE TO RECEIVE MANHOLE STEP

FIELD OF THE INVENTION

This invention relates to manholes and manhole steps and ladders.

BACKGROUND OF THE INVENTION

Pre-cast concrete manholes are widely used throughout the world to provide access to storm and sanitary sewer systems and a variety of other below-ground installations of piping, cables and the like. If such access is to be used, a ladder or steps must be provided to permit workers to descend into and climb out of the manhole. A variety of structures have been employed to make this possible, including ladders temporarily positioned in the manholes and ladders or steps permanently attached to the inside wall of the manholes.

One highly successful such step is disclosed in U. S. Pat. No. 4,100,997, which is incorporated herein by reference. U. S. Pat. No. 4,100,997 describes a steel reinforced plastic step that is injection molded of copolymer polypropylene. Support members that terminate in ends having molded, deformable annular projections are driven into pre-formed holes in the inside wall of the manhole.

In order to use a step of the type described in U. S. Pat. No. 4,100,977, holes must be formed in the inside face of the manhole having the proper size, location, orientation and spacing to receive the step legs. This has conventionally been accomplished by inserting metal rods or other forms from inside the form through appropriately located holes in the inner wall of the manhole form, so that properly shaped and located holes will be formed in the concrete manhole. Such hole-forming rods must also be withdrawn from inside the form before the formed concrete manhole and the form are separated. Doing so is time-consuming and arduous because it typically requires that a worker climb inside of the inner manhole form, which is difficult and unpleasant to do. Accordingly there is a need for a better method of forming holes in pre-cast manholes to receive steps.

Manholes frequently are manufactured with a plastic liner that forms the inside of the manhole and protects the concrete from chemicals that potentially would damage the concrete. Manufacture of manholes with such liners presents additional challenges to the provision of steps despite the presence of the liner and without breaching the protective layer it provides. For example, step holes may be drilled into the formed manhole, but some form of liner or other sealant must then be inserted into the step hole. Alternatively, the liner may be manufactured with deep indentations which act as step holes; however, such indentations may substantially increase the cost of the mold used to form the liner.

SUMMARY OF THE INVENTION

This invention is a frangible insert with plug and sleeve portions that is inserted in a prepositioned bushing in the wall of a manhole form from the convex, easily reached side of the inner form wall. A key in the sleeve portion is received in a keyway in the bushing in the form wall so that the insert is properly oriented in the form. Concrete is then poured into the form, enveloping and affixing the plug portion within the manhole wall.

The insert is manufactured of plastic or other suitable materials. A weakened, frangible region is provided on the sleeve in a position immediately adjacent to the form wall so that after the concrete is cured, the manhole and form can simply be separated, causing the plug portion, which is embedded in the concrete, to separate from the insert portion in the form bushing. Nothing needs to be removed before separating the form and cured manhole, with a consequent diminution in necessary labor by simplification of the insert insertion process and elimination of the need to remove a hole-forming component before separating the cured manhole and the form.

If the manhole is lined, the liner is positioned in the form on the outside surface of the inner form wall. Holes in the liner may be pre-formed or drilled or cut to coincide with the bushing on the inner wall. The plug portion of the insert is then positioned through each bushing and against the liner and plastic welded or otherwise affixed to form a tight seal between the insert and the liner. Alternatively, the plug insert may be plastic welded or otherwise affixed to the interior (concrete side) or the liner in the appropriate locations. The liner may then be penetrated to allow steps to be inserted into the insert. The liner may be penetrated before of after pouring and curing of the concrete.

Accordingly, it is an object of the present invention to provide an insert for forming step holes in a manhole that need not be removed after the manhole is formed.

Another object of the present invention is to provide an insert for forming step holes in a manhole having a frangible portion used to position the insert in the manhole form in which the frangible portion automatically separates from a hole-forming plug when the manhole form is separated from the manhole.

A further object of the present invention is to provide an insert for forming step holes in a lined manhole that prevents materials in the manhole from contacting the concrete protected by the liner.

Other objects, features, and advantages of the present invention will become apparent with reference to the remainder of the written portion and the drawings of this application, which are intended to exemplify and not to limit the invention.

DETAILED DESCRIPTION OF THE DRAWINGS

Figure 1:
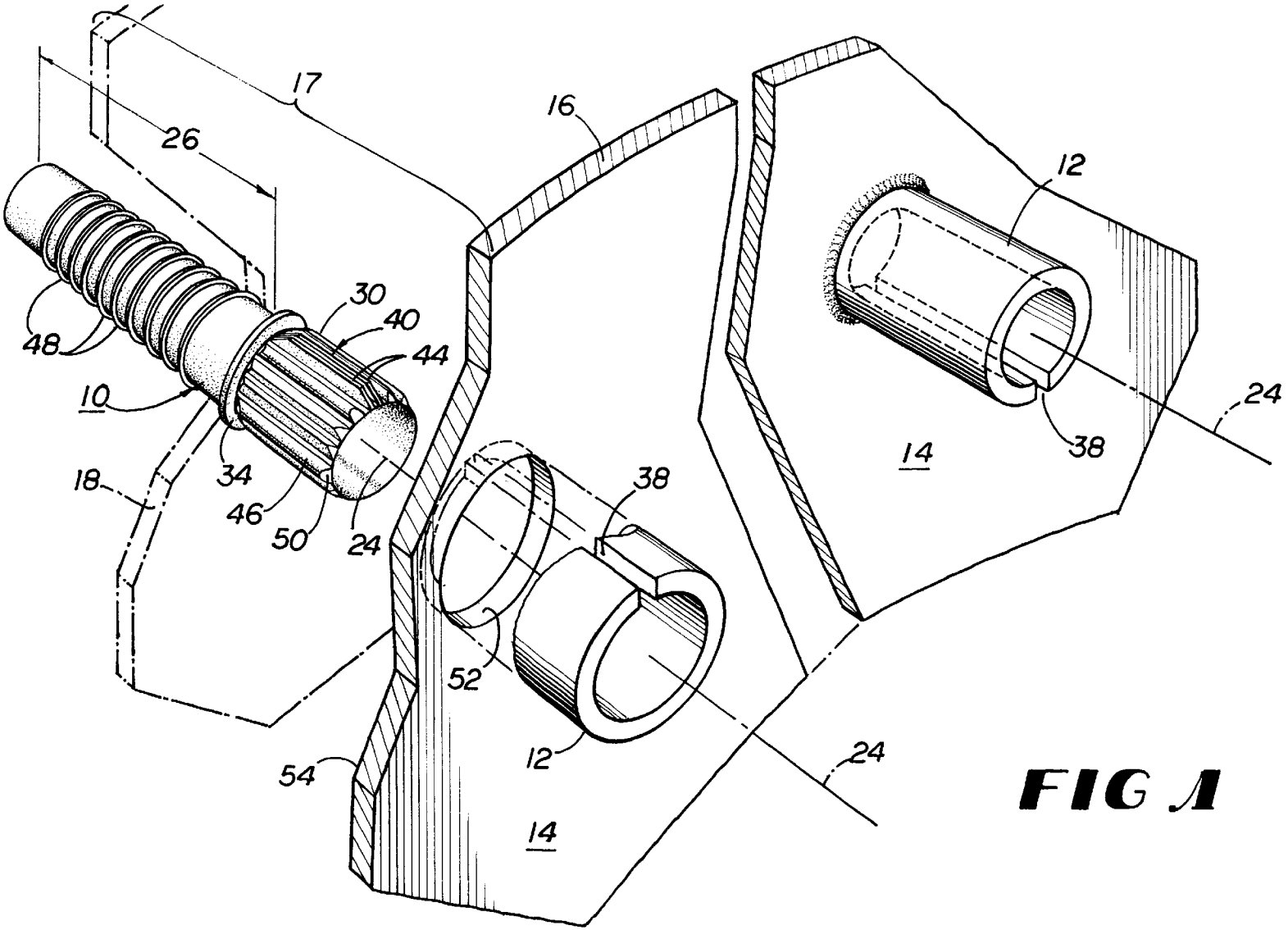
FIG. 1 is an exploded perspective view of a fragment of the inner form wall of a pre-cast concrete manhole form with the bushings and frangible insert of the present invention.

FIG. 1 illustrates a frangible insert 10 in accordance with the present invention. Insert 10 is shown prior to insertion in bushing 12 located on inside surface 14 of inner wall 16 of concrete form 17. Concrete form 17 also has outer form wall 18.

Figure 2:
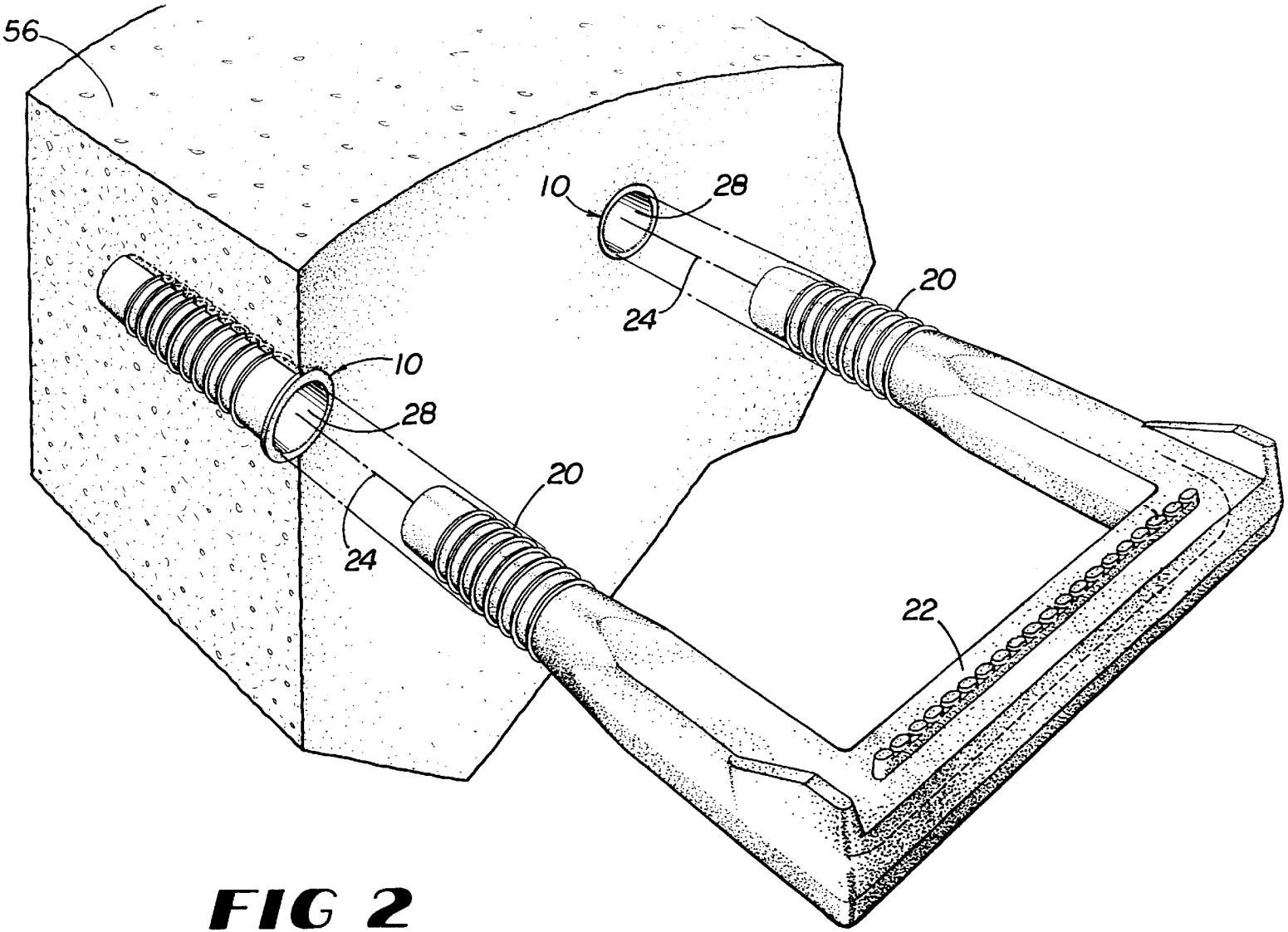
FIG. 2 is a second perspective view showing two frangible inserts of the present invention positioned in a section of a manhole wall with a manhole step of the type usable with the present invention shown exploded away from the wall.
Figure 3:
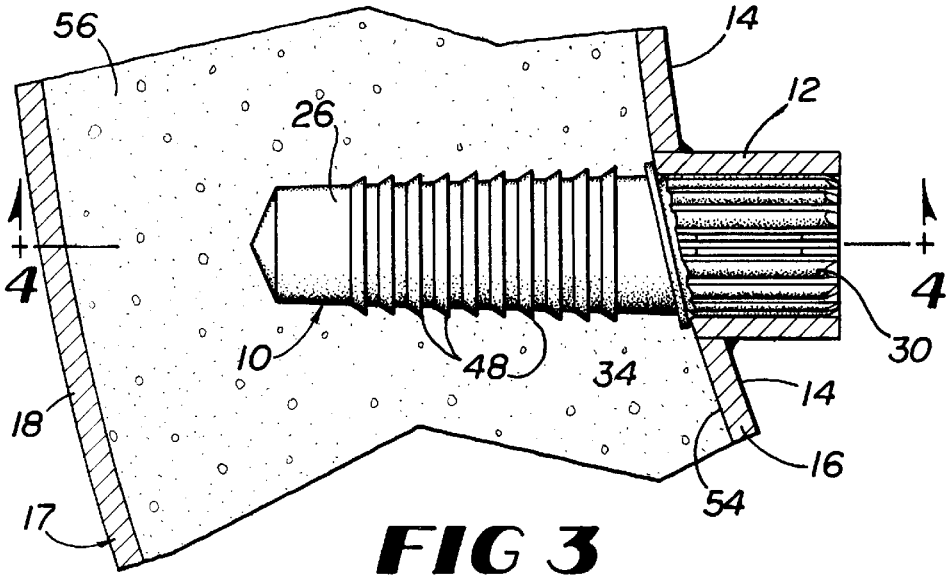
FIG. 3 is a top plan view of the frangible insert of the present invention shown positioned in a portion of a manhole wall surrounded by a manhole form and insert-receiving bushing, with the form, bushing and wall shown in section.
Figure 4:
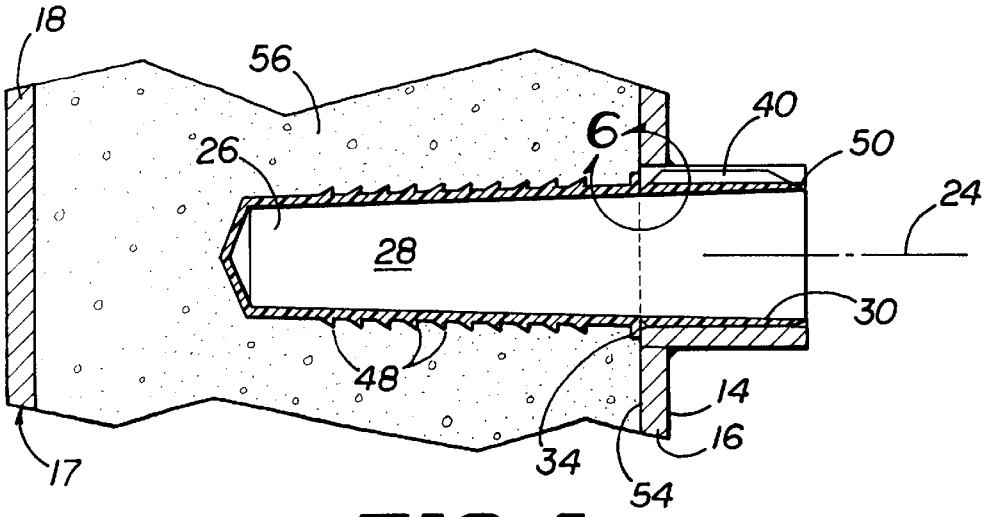
FIG. 4 is a section view taken along line 4—4 in FIG. 3.
Figure 5:
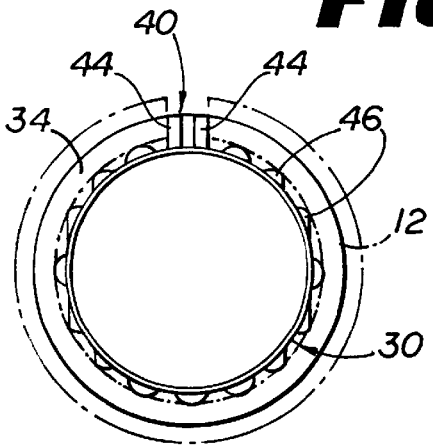
FIG. 5 is an axial view taken from the open end of the insert of the present invention with the insert receiving bushing shown in broken lines.

As shown in FIG. 2, two inserts 10 must be provided to receive the two legs 20 of a manhole step 22. Because the legs 20 are parallel, the longitudinal axes 24 of inserts 10 must also be parallel. As will be appreciated by reference to FIGS. 1, 2 and 3 (which is a top plan section view), because inner wall 16 of concrete form 17 is curved, the longitudinal axes 24 are not normal (or perpendicular) to the wall 16 where they intersect wall 16. Instead, the longitudinal axis 24 of each insert 10 must be oblique to wall 16, at complementary angles, so that the axes 24 will be parallel.

Figure 6:
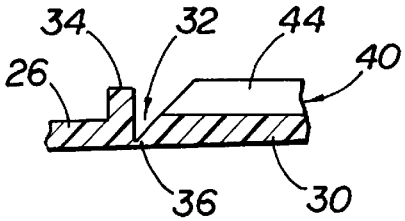
FIG. 6. is an enlarged view of the portion of FIG. 4 in circle 6.

Insert 10 has two principle portions, plug 26 and sleeve 30. Plug 26 forms hole 28 in which a leg 20 of step 22 is received. Sleeve 30 is received within bushing 12 of form 17. Plug 26 is attached to sleeve 30 along a frangible region 32 that may be best understood by reference to FIG. 6, which illustrates that frangible region 32 is a portion of insert 10 having a very thin wall created by an annular v-shaped groove defined by a collar 34 attached to plug 26 and an adjacent thin region 36 of sleeve 30. Frangible region 32 and collar 34, which is an upstanding portion of plug 26, lie, as may be seen in FIG. 3, in a plane generally parallel from inside wall 16 in the area of bushing 12, but oblique to longitudinal axis 24 at an angle chosen, in light of the radius of curvature of inner wall 16, so that longitudinal axis 24 of two inserts will be parallel. Of course, if steps 22 are to be installed in a flat surface, collar 34 may be positioned in a plane perpendicular to longitudinal axis 24.

Collar 34 allows sleeve 30 to be positioned within bushing 12 to a desired depth, thereby ensuring that frangible portion 32 is positioned such that removal of inner wall 14 from the completed manhole will fracture insert 10 at frangible portion 32. Thus, collar 34 may be any structure which prevents insert 10 from being inserted into bushing 12 to some point beyond frangible region 32, such as a bulges, tabs, or other obstructive protuberances.

Plug 26 and sleeve 30 need not be formed in one piece, but may be manufactured separately and joined thereafter by some readily frangible, fracturable or deformable connector. For example, a relatively thin cylindrical inner insert or coupling (not shown) may be provided. Sleeve 30 and plug 26 may be slipped over opposite ends of the coupling so that they abut in a configuration similar to that shown in the figures. Such a coupling would thereby hold sleeve 30 and plug 26 in the desired orientation for the manhole forming process but could be thin enough to fracture in the same manner as frangible region 32 or deform enough to permit separation of plug 26 from sleeve 30. In another alternative, sleeve 30 could be bonded to plug 26 that will fail, permitting the plug 26 easily to separate from sleeve 30.

Appropriate rotational positioning of insert 26 is achieved by use of a keyway 38 in each bushing 12. Keyway 38 receives key 40, which is positioned on the outside of sleeve 30. Keyway 38 may be a longitudinal slot on the inside of bushing 12, or, as illustrated in the figures, a longitudinal slot remaining after removing of an entire longitudinal wall section in a tubular bushing 12.

Key 40 in sleeve 30 may be an upstanding ridge or projection. Such a key 40 may be provided, as is illustrated in the figures, by positioning on the outside of sleeve 30 two side-by-side upstanding projections 44, which may be a structure superior to a solid key because projections 44 can bend slightly towards each other to accommodate narrow keyways 38. In an alternative not shown, sleeve 30 may include a keyway that corresponds to a ridge in bushing 12.

Sleeve 30 is generally cylindrical, although other shapes may be selected as appropriate. For example, sleeve 30 may be oval in shape to further ensure it is properly aligned when inserted in bushing 12. The outside of sleeve 30 may also be provided with longitudinal ribs 46 that contact bushing 12. Longitudinal ribs 46 lend sleeve 30 sufficient flexibility to ensure that sleeve 30 can compress if necessary to accommodate a narrow bushing 12, while providing sufficient friction to firmly secure insert 10 in place when concrete is poured into form 17. Ends 50 of ribs 46 and key 40 may be tapered to facilitate insertion of sleeve 30 in holes 52 in wall 16 of form 17 with which holes 52 bushings 12 are aligned.

Plug 26 is generally a cylindrical, frustro-conical or other appropriately shaped tube having angular barb-like rings 48 to anchor plug 26 in the concrete. Plug 26 is, of course, hollow and has an inside shape complementary to the outside shape of step 22 legs 20 so that the legs may be driven into the plug 28, as illustrated in FIG. 2.

Referring to FIG. 1, keyways 38 of bushings 12 may be oriented such that their positions differ by 180°, i.e., with one keyway up and the other keyway down. This orientation allows each insert 10 to be positioned so that collar 34 will lie against wall 16 and the longitudinal axes of the two inserts will be parallel.

As will be readily understood by reference to the figures, each insert 10 is positioned by inserting sleeve 30 into a hole 52 in bushing. 12 from the convex side 54 of wall 16. The insert 10 is rotationally positioned so that its key 40 will be received in the keyway 38, and the sleeve 30 is pressed into the bushing 12 until collar 34 abuts a convex side 56 of wall 16 so that when concrete 56 is placed between form wall 16 and 18 and allowed to cure, frangible region 32 is positioned at about the interface between cured concrete 54 and convex side 54 of inner wall 16. Form wall 16 and 18 are then removed, thereby causing each insert 10 to separate along frangible region 32 without the need for removal of any hole forming plugs. Sleeve 30 will typically remain within bushing 12 and may be easily pushed out from either side as, for instance, by pressing a new insert 10 into bushing 12.

Figure 7:
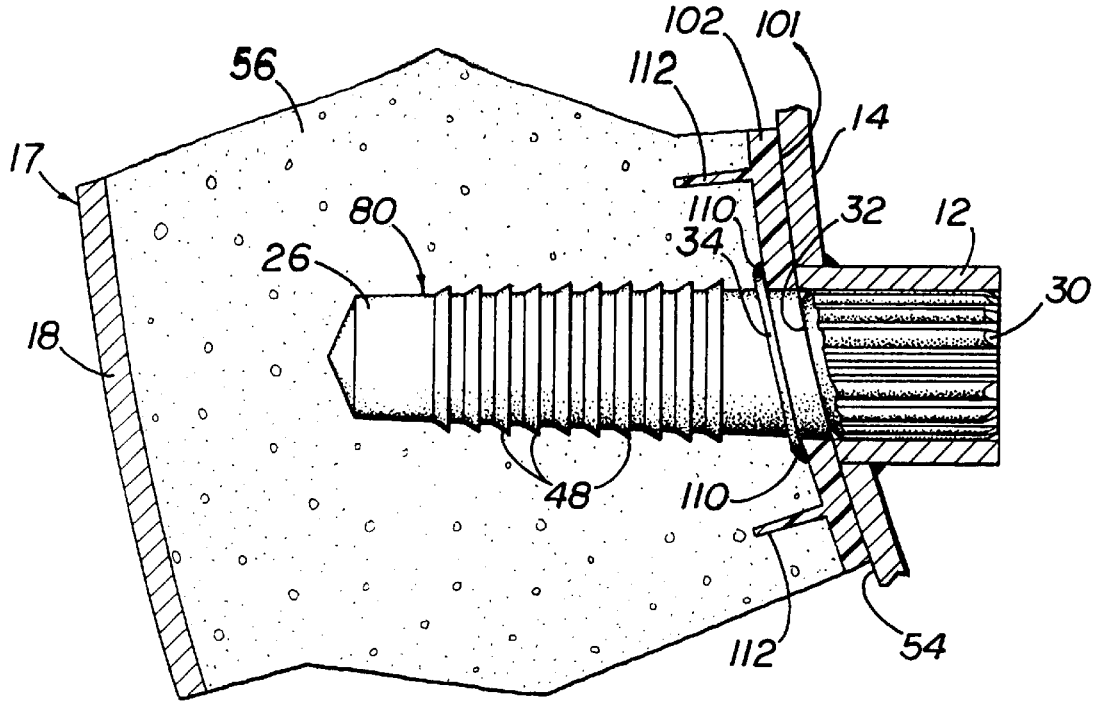
FIG. 7 is a top plan view of the frangible insert of a first alternate embodiment of the present invention shown positioned in a portion of a manhole wall surrounded by a manhole form, liner and insert-receiving bushing, with the form, liner, bushing and wall shown in section.

FIG. 7 illustrates a first alternate embodiment of an insert 80 for use with lined manholes. Inner wall 16 of the manhole form is lined with liner 102. Liner 102 may be made of any material suitable for protecting the underlying concrete from environmental damage, such as flexible plastic materials including, but not limited to polyethylene and polyvinyl chloride. Liner 102 includes ribs, fins or other suitable projections 112 which project inward to help secure liner 102 to the concrete of the manhole. Liner 102 is penetrated by an opening which corresponds to the opening 52 in inner wall 16.

Insert 80 is similar to insert 10, described above, having plug portion 26 and sleeve 30. Insert 80 is positioned in bushing 12 in the same manner as described above with respect to insert 10. Frangible region 32 is positioned on sleeve 30 so as to allow for the thickness of liner 102, i.e., so that it corresponds to the interface between inner surface 54 of inner wall 16 and outer surface 101 of liner 102 and is separated from collar 34 by about the thickness of liner 102. Collar 34 of insert 80 may be plastic welded (as shown by bead 110) or otherwise affixed to liner 102 in a manner that prevents corrosive materials from penetrating the joining between insert 80 and liner 102.

Figure 8:
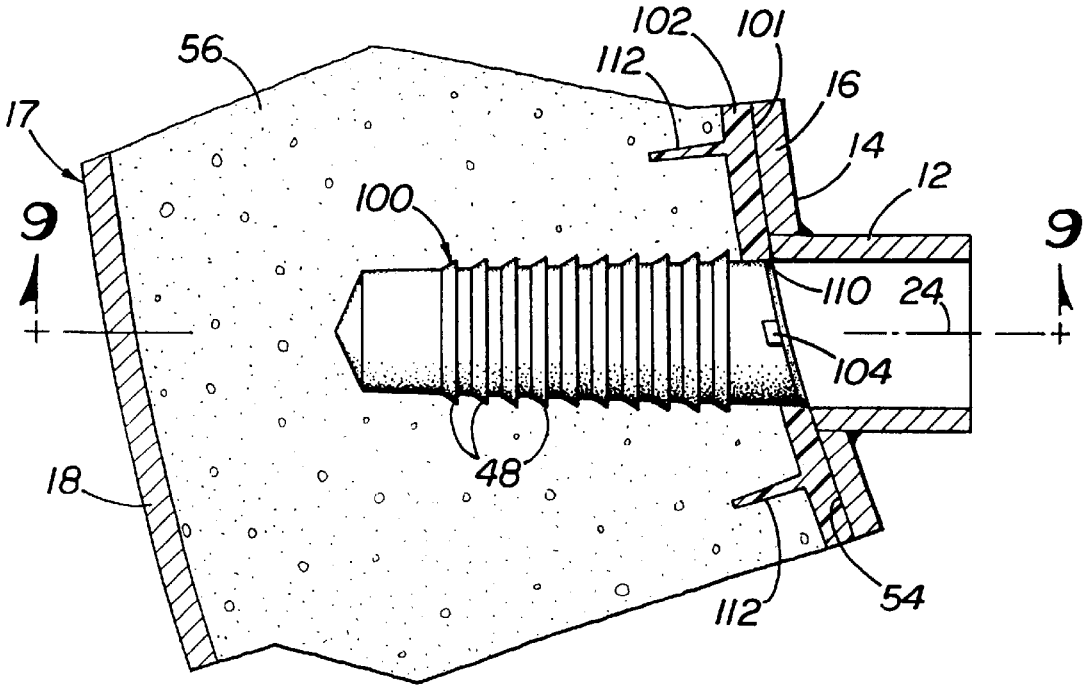
FIG. 8 is a top plan view of the frangible insert of a second alternate embodiment of the insert of present invention shown positioned in a portion of a manhole wall surrounded by a manhole form, liner and insert-receiving bushing, with the form, liner, bushing and wall shown in section.
Figure 9:
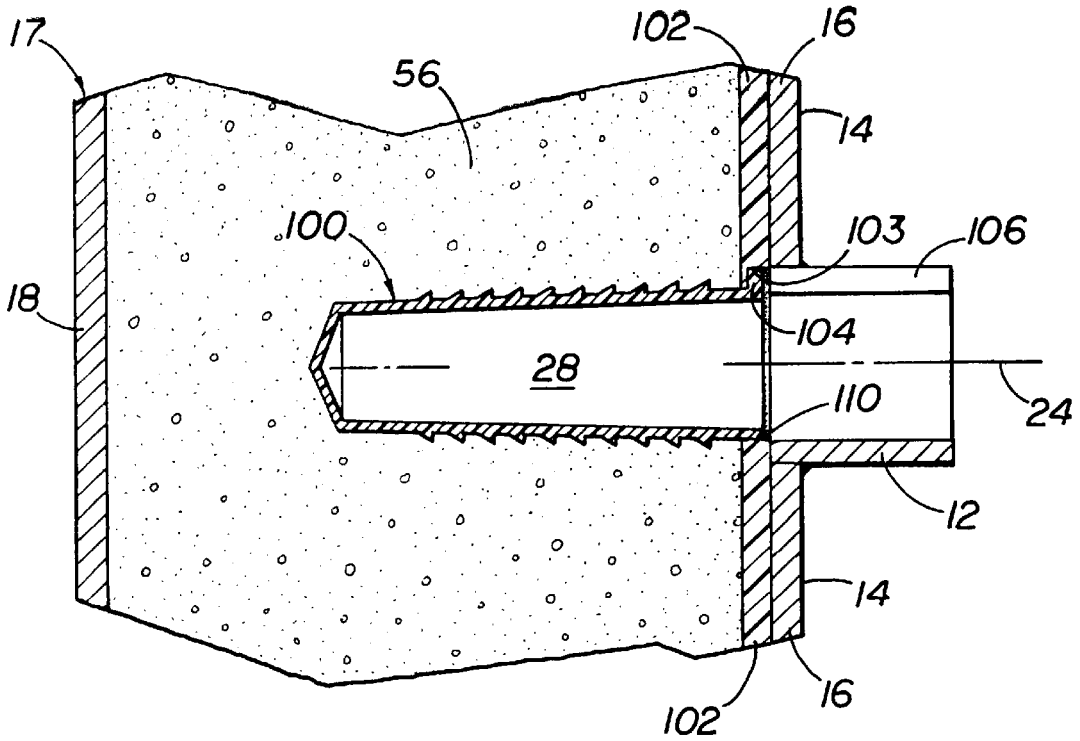
FIG. 9 is a section view taken along line 9—9 in FIG. 8.

FIGS. 8 and 9 illustrate a second alternate embodiment of an insert 100 in accordance with the present invention for use in lined manholes. Inner wall 16 of the manhole form is lined with liner 102. Liner 102 may be made of any material suitable for protecting the underlying concrete from environmental damage, such as flexible plastic materials including, but not limited to polyethylene and polyvinyl chloride. Liner 102 includes ribs, fins or other suitable projections 112 which project inward to help secure liner 102 to the concrete of the manhole.

Insert 100 includes a plug portion similar to that described above with respect to insert 10; however, insert 100 need not include a insert or frangible portion. End 104 of insert 100 is angled to conform with the radius of curvature of inner wall 16. As described with respect to insert 10, above, insert 100 must be positioned against liner 102 and inside wall 16 in the area of bushing 12, but oblique to longitudinal axis 24 at an angle chosen, in light of the radius of curvature of inner wall 16 of the manhole form, so that longitudinal axis 24 of two inserts will be parallel. Of course, if steps 22 are to be installed in a flat surface, insert 100 may be positioned in a plane perpendicular to longitudinal axis 24.

Appropriate rotational positioning of insert 100 is achieved by use of a keyway 106 in each bushing 12 and a corresponding keyslot 103 in liner 102. Keyway 106 receives key 104, which is positioned on the outside of insert 100. Keyway 106 may be a longitudinal slot on the inside of keyway 12 or may be, as is illustrated in FIG. 1, a longitudinal slot remaining after removing of an entire longitudinal wall section in a tubular bushing 12. Keyway 12 is aligned with keyway slots in wall 16 and liner 102. Key 104 on insert 100 may be an upstanding ridge or projection.

Insert 100 is inserted into bushing 12 and seated in liner 102 so that both liner 102 and end 104 are accessible through bushing 12. The user may then plastic weld (as shown by bead 110) insert 104 to liner 102. The plastic weld affixes insert 100 to liner 102 and seals the joint to prevent materials held by the manhole from penetrating liner 102 and damaging the underlying concrete. Alternatively, the user may apply adhesive or otherwise affix and seal insert 100 to liner 102.

Figure 10:
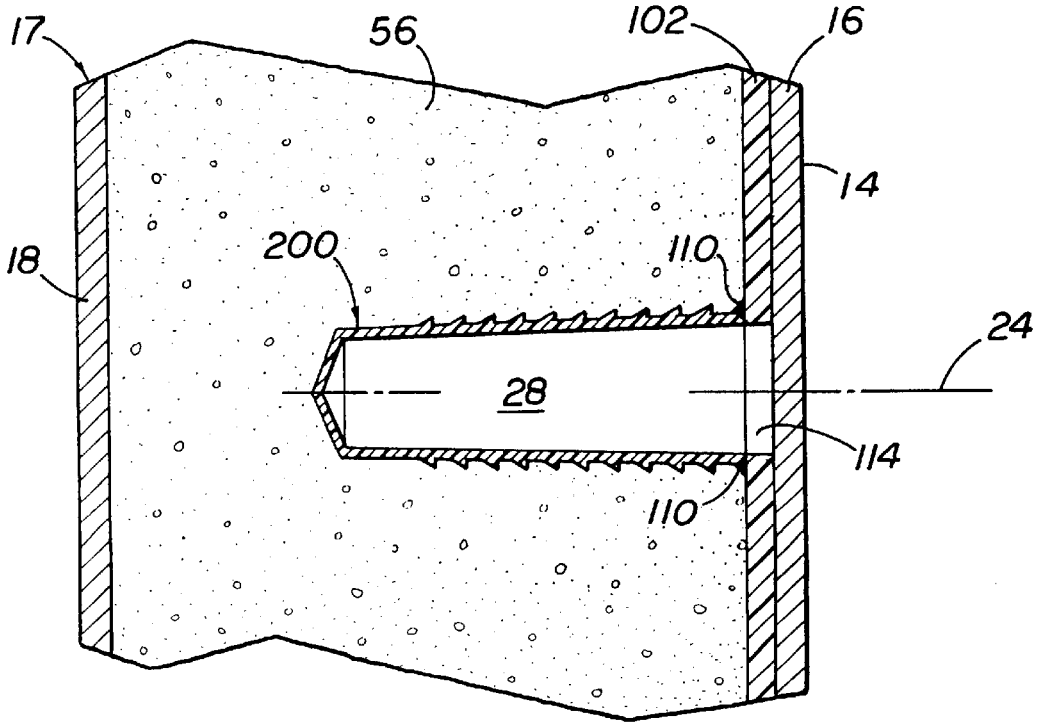
FIG. 10 is a third alternate embodiment of the present invention shown positioned in a portion of a manhole wall surrounded by a manhole form and liner with the form, liner and wall shown in section.

FIG. 10 shows a third alternative embodiment of an insert 200 in accordance with the present invention. Insert 200 includes a plug portion similar to those described above; however, the sleeve portion is removed or insert 200 is manufactured without a sleeve portion. Insert 200 is then affixed directly to liner 102 by plastic welding (as shown by bead 110) or adhesives as described above. For example, liner 102 may be laid flat on the ground and inserts 200 are affixed thereto in the desired positions. Liner 102 is then positioned adjacent to inner wall 16 of the manhole form. Hole 114 is provided in liner 102 so that steps may be inserted into insert 200 once the concrete of manhole is cured. Hole 114 may be made before or after affixing insert 200 to liner 102 and before or after pouring and curing the concrete.

As will be readily appreciated by those skilled in the art, inserts 10 may be advantageously manufactured by molding them of plastic, such as any of a variety of a thermoplastic resins, including polyvinyl chloride (PVC), and other suitable materials.

As those skilled in the art will appreciate, the particular embodiment of this invention described above and illustrated in the figures is provided for explaining the invention, and various alterations may be made in the structure and materials of the illustrated embodiment without departing from the spirit and scope of the invention as described above and defined in the following claims.

We claim:

1. An assembly for forming a manhole step hole in a wall of a concrete manhole having a radius of curvature, comprising an insert having a longitudinal axis and comprising a hole-forming plug attached to a sleeve by a frangible connection that lies generally on a plane oblique to the longitudinal axis, and a bushing for affixation to an inner wall of a concrete form, extending outward from the concrete form a distance sufficient to position the insert during formation of the manhole and adapted to receive the sleeve such that the frangible connection is positioned adjacent the inner wall generally on a plane normal to the radius of curvature.

2. The assembly of claim 1 in which one of the bushing and sleeve has a key and the other of the bushing and sleeve has a keyway so that the sleeve is received in the bushing in a predetermined rotational orientation.

3. The assembly of claim 2, wherein the bushing has a keyway and the sleeve has a key.

4. The assembly of claim 3, wherein the key comprises two longitudinal side-by-side projections.

5. The assembly of claim 1, wherein the sleeve has longitudinal ribs that contact the bushing.

6. A method for forming step holes in a manhole comprising the steps of:

a) providing a concrete form having at least one bushing affixed to an inner wall of the form, extending outward from the concrete form a distance sufficient to position the insert during formation of the manhole and communicating with a corresponding opening in the inner wall, the inner wall having a radius of curvature; and b) inserting an insert into the bushing wherein the insert is attached to a plug having a longitudinal axis by a frangible connection that lies generally on a plane oblique to the longitudinal axis such that the frangible connection is positioned adjacent the inner wall generally on a plane normal to the radius of curvature.

7. The method of claim 6 further comprising the steps of:

c) depositing a quantity of casting material into the concrete form;

d) allowing the casting material to cure; and e) simultaneously removing the inner wall and fracturing a frangible connection between the insert and the plug.

8. The method of claim 7 further comprising the step of:

f) inserting a manhole step into the plug.

9. The method of claim 6 in which the step of inserting the insert further comprises the step of aligning a key positioned on the insert with a keyway defined in the bushing.

10. The method of claim 6 further comprising the step of affixing the insert to a liner abutting the inner wall of the form.

11. An assembly for forming step holes in a wall of a manhole having a radius of curvature comprising:

1) an insert having:

a) a hollow frustro-conical plug having a longitudinal axis and an obstructive protuberance positioned at a first end, the obstructive protuberance lying generally on a plane oblique to the longitudinal axis;

b) a sleeve positioned adjacent the protuberance; and c) a frangible connection that lies generally on a plane to the longitudinal axis between and joining the plug and the sleeve insert, wherein the sleeve is adapted to be received in a bushing affixed to an inner wall of a concrete form such that the frangible connection and the obstructive protuberance are positioned adjacent the inner wall generally on a plane normal to the radius of curvature; and 2) a bushing for affixation to an inner wall of a concrete form, extending outward from the concrete form a distance sufficient to position the insert during formation of the manhole and adapted to receive the sleeve such that the frangible connection is positioned adjacent the inner wall generally on a plane normal to the radius of curvature.

12. A manhole form comprising:

a) an inner wall defining at least one opening having a keyslot;

b) a bushing affixed to the inner wall of a concrete form having a keyway, communicating with the opening, extending outward from the concrete form a distance sufficient to position an insert during formation of the manhole and for holding the insert such that a frangible connection is positioned adjacent the inner wall generally on a plane normal to a radius of curvature;

c) a frangible insert with a longitudinal axis positioned at least partially within the bushing such that a frangible connection lying generally on a plane oblique to the longitudinal axis between an insert portion and a plug portion of the insert is positioned adjacent to an outer surface of the inner wall and a key affixed to the insert portion is positioned in the keyslot and the keyway.

13. The manhole of claim 12, wherein the frangible connection lies generally on a plane oblique to a longitudinal axis of the insert.

14. The manhole of claim 12 further comprising a liner abutting the inner wall and affixed to the insert.

15. An assembly for forming a manhole step hole in a wall of a lined concrete manhole, comprising an insert, having a longitudinal axis and a hole-forming plug attached to a sleeve by a frangible connection that lies generally on a plane oblique to the longitudinal axis, and a bushing for affixation to an inner wall of a concrete form, extending outward from the concrete form a distance sufficient to position the insert during formation of the manhole and adapted to receive the sleeve such that the frangible connection is adapted to be positioned adjacent a liner of the lined concrete manhole, generally on a plane normal to the radius of curvature.

16. A manhole form comprising:

a) an inner wall defining a first at least one opening having a first keyslot;

b) a liner positioned against the inner wall and defining a second at least one opening having a second keyslot and corresponding to the at least one first opening and first key slot;

c) a bushing affixed to the inner wall of a concrete form having a keyway, communicating with the first and second openings, extending outward from the concrete form a distance sufficient to position an insert during formation of the manhole and for holding the insert such that a frangible connection is positioned adjacent the inner wall generally on a plane normal to a radius of curvature;

d) a plug having a longitudinal axis within the bushing affixed to the liner such that the longitudinal axis is generally oblique to the inner wall.

17. A method for forming step holes in a manhole comprising the steps of:

a) providing a concrete form having at least one bushing affixed to an inner wall of the form, extending outward from the concrete form a distance sufficient to position an insert during formation of the manhole and communicating with a corresponding opening in the inner wall;

b) providing a liner;

c) inserting a plug having a longitudinal axis into the bushing; and d) affixing the plug to liner such that the longitudinal axis is generally oblique to the inner wall.

18. The method of claim 17 further comprising the steps of:

e) depositing a quantity of casting material into the concrete form; and f) allowing the casting material to cure.

19. The method of claim 18 further comprising the step of:

g) inserting a manhole step into the plug.

20. The method of claim 17 in which the step of inserting the plug further comprises the step of aligning a key positioned on the plug with a keyway defined in the bushing.

21. A manhole form comprising:

a) a liner positioned against an inner wall of the manhole form;

b) a bushing affixed to the inner wall of a concrete form, extending outward from the concrete form a distance sufficient to position an insert during formation of the manhole and for holding the insert such that a frangible connection is positioned adjacent the inner wall generally on a plane normal to a radius of curvature; and c) a plug having a longitudinal axis affixed to the bushing such that the longitudinal axis is generally oblique to the inner wall.

22. The manhole form of claim 21 further comprising an opening defined in the liner and communicating with a cavity defined by the plug.

23. A method for forming step holes in a manhole comprising the steps of:

a) providing a concrete form having an inner wall and a bushing affixed to the inner wall of the concrete form, extending outward from the concrete form a distance sufficient to position an insert during formation of the manhole and for holding the insert such that a frangible connection is positioned adjacent the inner wall generally on a plane normal to a radius of curvature;

b) providing a liner; and c) affixing a plug having a longitudinal axis to the liner such that the longitudinal axis is generally oblique to the inner wall.

24. The method of claim 23 further comprising the steps of:

d) depositing a quantity of casting material into the concrete form; and e) allowing the casting material to cure.

25. The method of claim 23 further comprising the step of:

d) penetrating the liner in a position corresponding to the location of the plug.

26. The method of claim 25 further comprising the step of:

e) inserting a manhole step through the liner and into the plug.

* * * * *